United States Patent [19]

Remington

[11] 4,221,452

[45] Sep. 9, 1980

[54] ELECTRICAL CONNECTOR

[76] Inventor: Richard C. Remington, 10 Van Riper Ave., Pompton Plains, N.J. 07444

[21] Appl. No.: 63,981

[22] Filed: Aug. 6, 1979

[51] Int. Cl.[3] ..... H01T 13/04

[52] U.S. Cl. ..... 339/143 S; 339/26

[58] Field of Search ..... 339/26, 140 S, 143 S, 339/182 R

[56] References Cited

U.S. PATENT DOCUMENTS

| | | | |
|---|---|---|---|
| 2,409,732 | 10/1946 | Browne et al. | 339/143 S |
| 3,435,404 | 3/1969 | Kato | 339/182 R |

FOREIGN PATENT DOCUMENTS

| | | | |
|---|---|---|---|
| 296173 | 1/1917 | Fed. Rep. of Germany | 339/26 |
| 1563471 | 4/1969 | France | 339/143 S |
| 393952 | 6/1933 | United Kingdom | 339/26 |

*Primary Examiner*—Neil Abrams

[57] ABSTRACT

A connector for electrically connecting a power source to a glow plug. An electrically conductive cylindrical housing encloses an insulated central conductor which is spring biased toward one end of the cylinder. The open end of the cylinder is formed to fit over the nut of a typical glow plug and permit the connector to be easily manipulated to a locked, vibrationless electrical contact with the glow plug.

5 Claims, 6 Drawing Figures

ELECTRICAL CONNECTOR

BACKGROUND OF THE INVENTION

Miniature internal combustion engines of the typed used to power model airplanes, cars and boats generally use glow plugs for fuel ignition. Glow plugs are similar to spark plugs in which the gap is replaced by a filament. When a voltage is placed across the filament during engine cranking, the filament becomes sufficiently hot to ignite the primer fuel after which combustion is self-sustaining and external voltage is no longer needed.

A typical glow plug comprises a center electrode fixed within a cylindrical housing. The housing is threaded at one end for mounting into the cylinder head wall. The filament is connected between an end of the center electrode within the cylinder and the housing. The housing also has formed therein a nut for tightening and removal of the glow plug from the cylinder head wall. During ignition a power source is connected across the filament by connecting a lead to the center electrode and the housing or ground.

Heretofore, connection has been made to the glow plug by the use of alligator clips, friction and spring—clothespin type connectors. A serious disadvantage of these types of connectors is that they continually come off during engine cranking due to vibration and poor locking features. In addition such connectors pose a safety hazard due to being rotated into the propeller by engine vibration and thrown by the propeller at a high rate of speed. Further, the electrical contact provided by these connectors is unreliable and they have a poor life span.

These connectors are inconvenient to use since, as aforesaid, they continually come off, make poor electrical contact, are not easily manipulated, and often require the engine cowling to be removed during use. The connector of the present invention provides a safe, secure, reliable, and easy means for connecting a power source to a glow plug and is unaffected by engine vibration.

SUMMARY OF THE INVENTION

The connector of the present invention comprises an electrically conductive metal cylinder which encloses a center contact which is spring biased toward an open end of the cylinder. The center contact which is electrically insulated from the cylinder is designed to electrically contact the center electrode of a glow plug while the cylinder makes electrical contact with the housing. Lead wires are connected to the cylinder and center contact through the other end of the cylinder.

The open end of the cylinder is formed to slip easily over the nut of the glow plug and then to be locked to the nut against rotational movement by formations in the cylinder which mate with the points of the nut. Longitudinal movement of the connector is prevented by formations on the bottom of the cylinder held against portions of the bottom surface of the nut by action of the center contact spring biased against the center electrode of the glow plug.

DRAWINGS

DESCRIPTION

Figure 1:
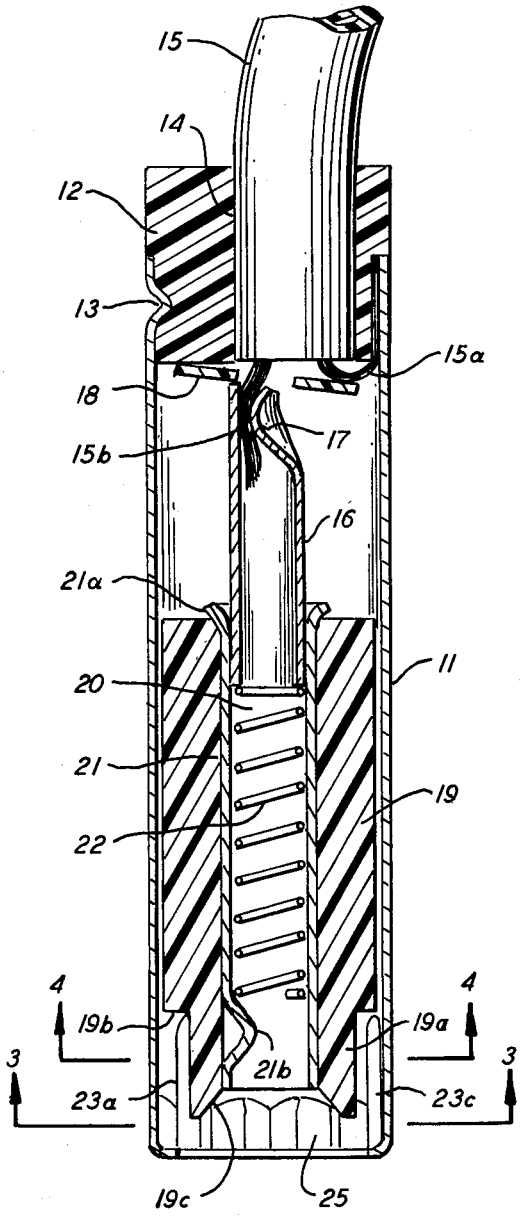
FIG. 1 is a cross sectional view of a preferred embodiment of the present invention.

FIG. 1 shows the connector 10 of the present invention in its normal rest state. The connector comprises a cylindrical housing 11 made of an electrically conductive material. The upper end of housing 11 has a cap 12 inserted therein and secured by crimps 13 made in housing 11. The cap 12 is made of an electrically insulating material e.g. plastic. The cap 12 has an opening 24 therethrough for receiving one end of a wire 15 whose other end (not shown) is connectable to a power source such as a battery. The wire 15 is supported and held by the cap 12. One lead **15*a* of the wire 15 is securedly held in electrical contact with housing 11 by the cap 12 by being held between the outer periphery of the cap 12 and the inner periphery of the housing 11. The other lead 15*b* is held in a tube 16 by crimp 17. An insulating washer 18 is disposed about lead 15*b* and among other functions described hereinbelow, serves to maintain leads 15*b* and 15*a*** electrically insulated.

A plunger 19 is disposed within housing 11. The plunger 19 has an outside diameter slightly less than the inside diameter of housing 11 so as to be sidable therein. The plunger 19 is made of an insulating plastic. The lower end **19*a* has a smaller outside diameter than the upper end forming a shoulder 19*b* as shown. The bottom 19*c* is tapered inwardly toward a central bore 20 of the plunger 19** to form a conical surface for receiving the center electrode of a glow plug described below.

Tightly fitted within bore 20 is a tube 21 made of electrically conductive metal. The tube 21 is flared at its upper end **21*a* to help retain it in the bore 20 against the action of a spring 22**.

Figure 2:
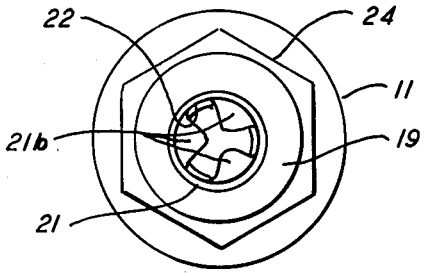
FIG. 2 is a bottom view of the connector of FIG. 1.

The spring 22 is disposed within tube 21 with its bottom portion retained by and resting on dimples **21*b* which are best seen in FIG. 2. The bottom end of electrically conducting tube 16 is disposed within tube 21 and is dimensioned to be easily slidable therein and in electrical contact therewith. The bottom of tube 16 acts as a seat for the top end of the spring 22**.

The connector 10 as shown in FIG. 1 is in its normal rest state.

The plunger 19 along with tube 21 is normally biased downwardly by the action of the spring 22 against the bottom of tube 16 and the crimps **21*b*. Further downward motion of the plunger 19 is prevented by the restraining action of the three ribs 23*a*, 23*b*, and 23*c* (best seen in FIG. 4) against the shoulder 19*b***.

Figure 3:
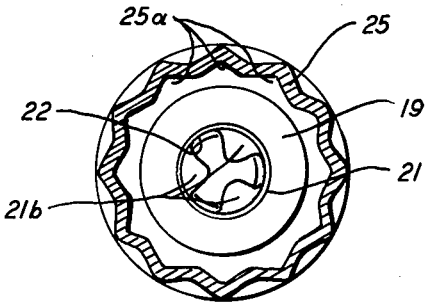
FIG. 3 is a view of the connector of FIG. 1 taken along lines 3—3.
Figure 4:
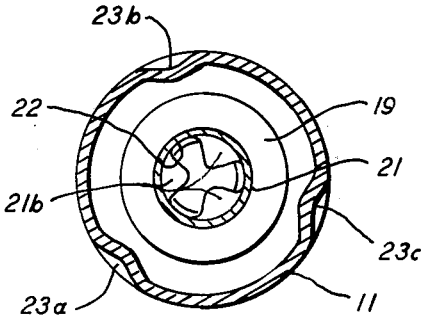
FIG. 4 is a view of the connector of FIG. 1 taken along lines 4—4.

The bottom end of housing 11 is pierced and swedged to form three distinct cross sections as seen in FIGS. 2, 3 and 4.

FIG. 2 shows the bottom of connector 10. The bottom is pierced in the shape of a hexagon indicated by reference numeral 24.

FIG. 3 shows the shape of the housing 11 taken through lines 3—3 of FIG. 1. At this level the housng is swedged in the shape of a double hexagon 25 which is a form similar to that of a twelve point socket wrench. Six of the points of the double hexagon sweding 25 are in axial alignment with the six points of the hexagonal piercing 24. The double hexagon swedging 25 end at a height relative to the rest of the housing 11 substantially as shown in FIG. 1.

FIG. 4 is a view of the bottom of housing 11 taken through lines 4—4 of FIG. 1. FIG. 3 shows the three ribs 23*a*, 23*b*, and 23*c* referred to previously. The ribs which are extensions of three of the swedgings shown in FIG. 3 extend upwardly to a higher level relative to the rest of the housing 11 then do the swedgings 25. The ribs 23*a*, 23*b* and 23*c* are spaced 120° apart and have the same position as three of the swedgings in the relative positions shown in FIGS. 3 and 4.

Before describing the manner of locking the connector 10 onto a glow plug, a glow plug 26 of a type with which the present invention may be used is described with reference to FIG. 5. The glow plug comprises a housing 27. The upper portion of the housing 27 is formed into the shape of a hexagon nut 28. The lower end 29 of housing 27 is threaded to permit the glow plug 26 to be screwed tightly into a cylinder head wall 30 placing the glow plug filament 31 in communication with the piston chamber 32. The primary purpose of the nut 28 is to tighten or remove the glow plug 26 from the cylinder head wall. The glow plug 26 has a center electrode 33 with a conically shaped tip 33*a*. The center electrode 33 and housing 27 provide the electric circuit path through the filament as when housing 11 contacts housing 27 and center electrode 33 contacts tube 21. The hexagonal nut 28 has a lip 34 since the nut 28 has a larger diameter than the neck 35 of the housing 27.

Figure 5:
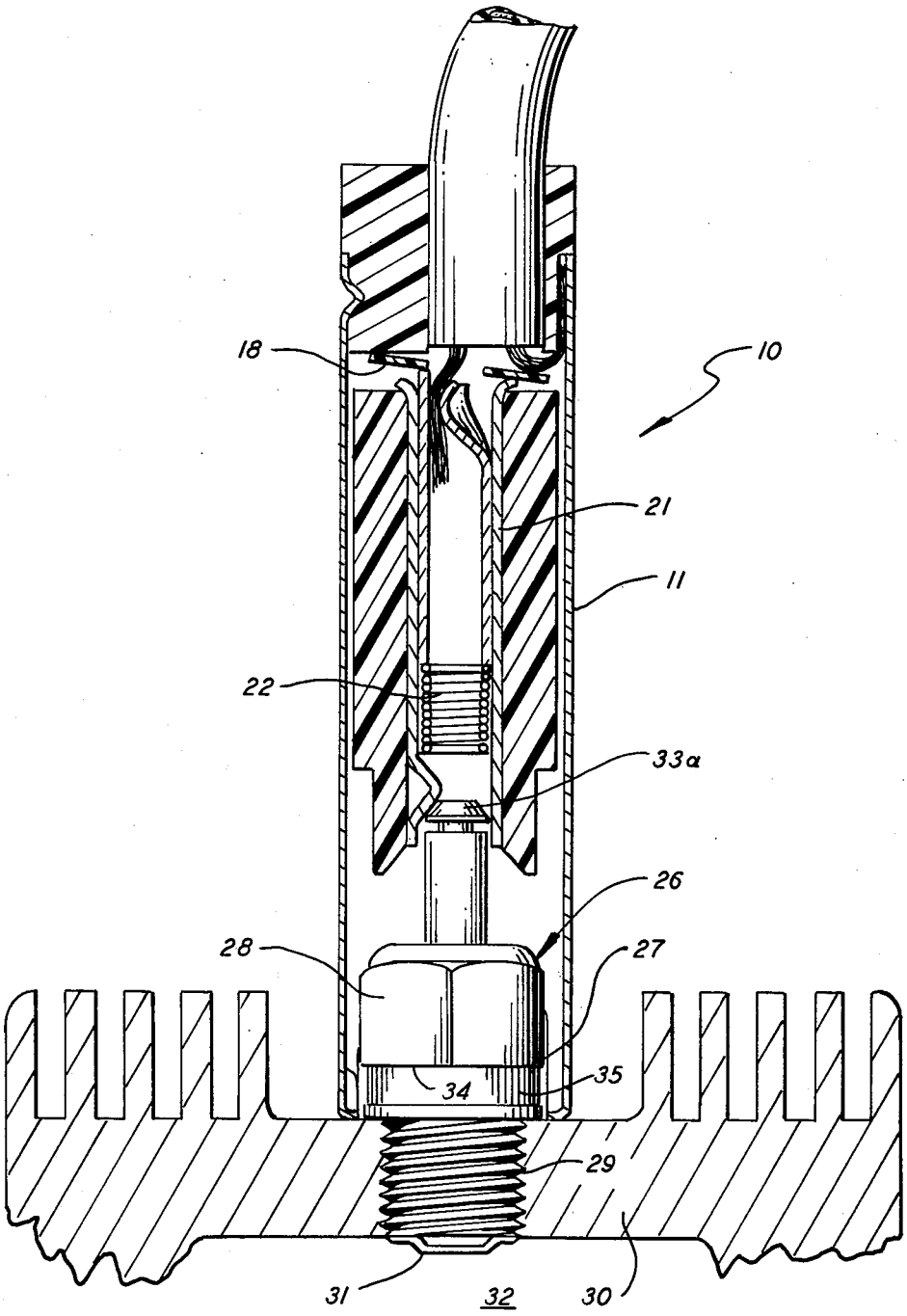
FIG. 5 is a cross-sectional view of the connector fully held down over the glow plug before locking.

FIG. 5 shows the connector 10 placed over the glow plug 26 in the fully held down position. This is accomplished by placing the connector over the glow plug 26 and rotating it about its longitudinal axis until the hexagonal piercing 24 is felt to align with the nut 28. At this point the connector 10 is pushed down as far as it will go as shown in FIG. 5. In this position spring 22 is substantially fully compressed and plunger 19 is in its uppermost position within housing 11. As can be seen insulating washer 18 acts as a stop for the spring loaded tube 16 and prevents flare 12*a* of tube 21 from electrically contacting lead 15*a* causing a short.

In this position the connector 10 is free to be rotated about its longitudinal axis thirty degrees clockwise until three of the points of the hexagonal nut 28 contact the three ribs 23*a*, 23*b* and 23*c*.

Figure 6:
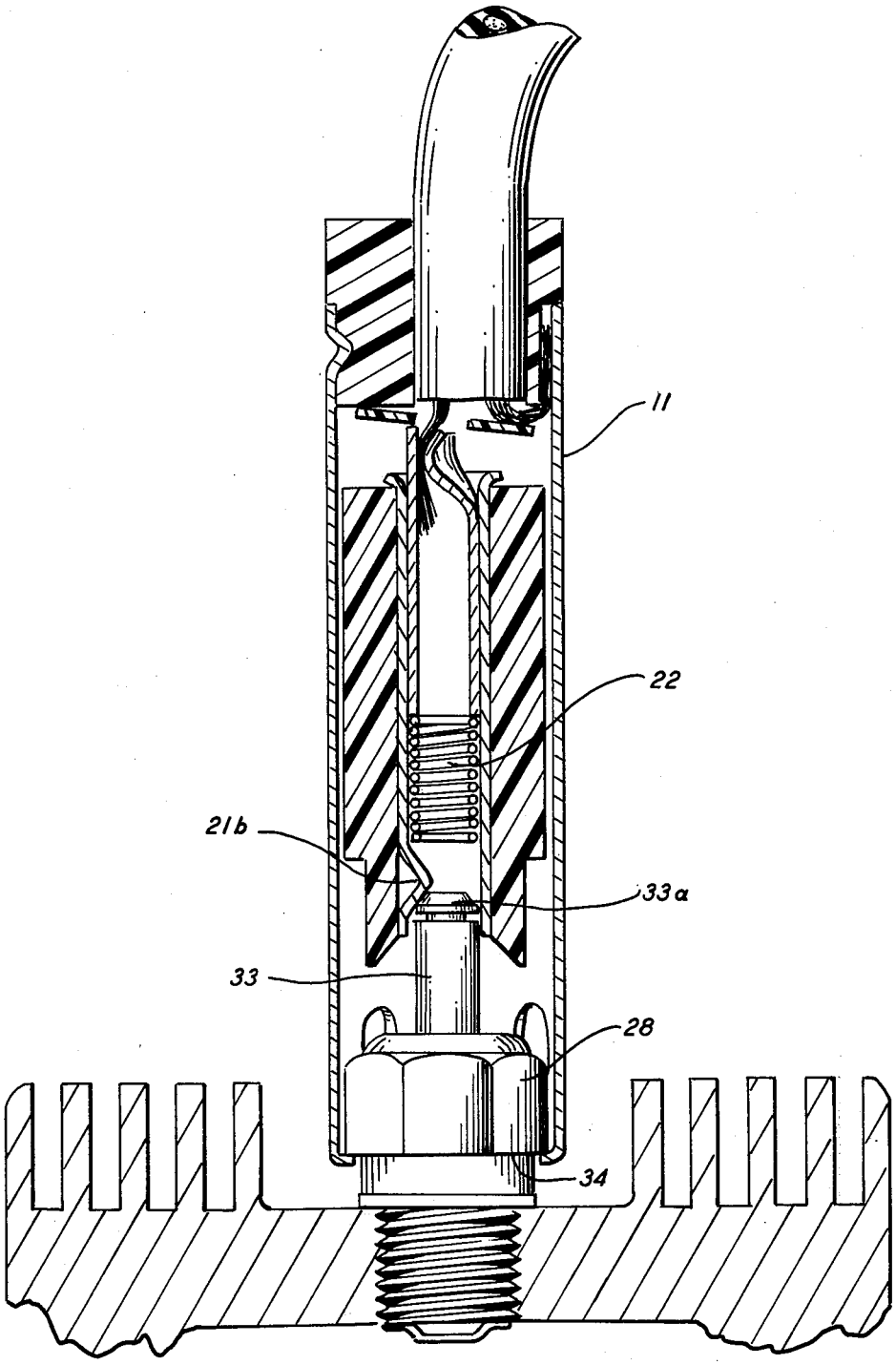
FIG. 6 is a cross-sectional view of the connector locked onto the glow plug.

At this point the connector 10 is released and the spring 22 causes housing 11 to be raised to the position shown in FIG. 6. The points of the hexagonal nut 28 are displaced from their counterparts in the piercing 24 and bear against the portion of the bottom of housing 11 betwen the points. Thus, the connector 10 is held by the action of the spring 22 causing crimps 21*b* of tube 21 to bear against tip 33*a* of the center electrode 33. This holds the connector 10 fixed in the longitudinal direction.

In this position the six points of the hexagonal nut are disposed within six of the recesses 25*a* formed by the sledgings 25. This prevents radial movement of the connector 10 which is securely locked onto nut 25 with the housing 11 making electrical contact with the nut 28 and therefore the housing 27 of the glow plug 26. At the same time tube 21 via crimps 21*b* makes electrical contact with the center electrode 33 via tip 33*a*.

After ignition the connector 10 is again pushed all the way down and rotated thirty degrees in he counterclockwise direction i.e. until the points of the nut 28 contact the ribs 23*a*, 23*b* and 23*c*. In this position the points of the nut 28 are aligned with six of the recesses 25*a* of the sledging 25 as well as the six counterpart points of the hexagonal piercing 24. The connector can now be raised off of the nut 28.

While the connector 10 of the present invention has been described as cooperating with the hexagonal nut of a typical glow plug, it should be understood that the housing 11 may be formed with different piercings and sledging to cooperate with glow plug nuts shaped other than hexagonal.

Other modifications of the present invention are possible in light of the above description which should not be construed as placing limitations thereon beyond those limitations expressly set forth in the claim.

What is claimed is:

1. A connector, comprising in combination:

a cylindrical, electrically conductive housing, electrode means slidably disposed within said housing, spring means normally biasing said electrode means toward one end of said housing, said electrode means comprising an electrically insulating plunger slidably disposed within said housing, said plunger having a longitudinal bore therethrough, a first electrically conductive tube fixedly disposed within said bore, said one end of said housing pierced to form a hexagonal opening therein, a plurality of indentations formed in the wall at said one end of said housing with adjacent indentations forming recesses therebetween, each point of said hexagonal opening alligned with one of said recesses, at least one of said indentations extended upward in said wall and located between adjacent points of said hexagonal piercing, said plunger having a shoulder near one end therof normally held against said extended indentation by said spring means.

2. A connector according to claim 1 further comprising, a second electrically conductive tube having one end secured to said second lead, the other end of said second tube slidably disposed within one end of said first tube, said second tube adapted to move within said second tube in physically contacting relationship therewith.

3. A connector according to claim 2 wherein said first tube has a plurality of crimps formed in the other end thereof.

4. A connector according to claim 3 further comprising, a spring disposed within said first tube, one end of said spring abutting against said crimps and the other end of said spring abutting against said other end of said second tube.

5. A connector according to claim 4 wherein said plunger is of such a length relative to said housing that it can move within said housing such that said one end clears said plurality of indentations and said other end of said second tube never breaks contact with said first tube.

* * * * *